US005762215A

United States Patent [19]

Ogden

[11] Patent Number: 5,762,215

[45] Date of Patent: Jun. 9, 1998

[54] CAP FOR A CONTAINER

[75] Inventor: Brian Leslie Ogden, Dartford, Great Britain

[73] Assignee: Glaxo Wellcome, Research Triangle Park, N.C.

[21] Appl. No.: 182,104

[22] PCT Filed: Jul. 29, 1992

[86] PCT No.: PCT/GB92/01403

§ 371 Date: Feb. 3, 1994

§ 102(e) Date: Feb. 3, 1994

[87] PCT Pub. No.: WO93/02940

PCT Pub. Date: Feb. 18, 1993

[30] Foreign Application Priority Data

Jul. 30, 1991 [GB] United Kingdom ..... 9116389
Oct. 18, 1991 [GB] United Kingdom ..... 9122144

[51] Int. Cl.[6] ..... B65D 55/02

[52] U.S. Cl. ..... 215/220; 215/217; 215/277

[58] Field of Search ..... 215/216, 217, 215/218, 219, 220, 223, 329, 330, 277, 278

[56] References Cited

U.S. PATENT DOCUMENTS

| | | | |
|---|---|---|---|
| 3,776,407 | 12/1973 | Cistone . | |
| 3,804,282 | 4/1974 | Komendowski . | |
| 3,923,183 | 12/1975 | Choksi et al. . | |
| 3,972,436 | 8/1976 | Grau . | |
| 4,011,960 | 3/1977 | Mauvernay et al. . | |
| 4,015,400 | 4/1977 | Choksi et al. . | |
| 4,353,474 | 10/1982 | Luker . | |
| 4,385,705 | 5/1983 | Kusz . | |
| 4,433,789 | 2/1984 | Gibilisco . | |
| 4,520,938 | 6/1985 | Finke . | |
| 4,527,701 | 7/1985 | Schaubeck | 215/220 |

(List continued on next page.)

FOREIGN PATENT DOCUMENTS

| | | |
|---|---|---|
| 29331 | 11/1972 | Australia . |
| 0120644 | 10/1984 | European Pat. Off. . |
| 0182519 | 5/1986 | European Pat. Off. . |
| 0184795 | 6/1986 | European Pat. Off. . |
| 0301914 | 2/1989 | European Pat. Off. . |
| 0434308 | 6/1991 | European Pat. Off. . |
| 2246465 | 5/1975 | France . |
| 2256082 | 7/1975 | France . |
| 2301447 | 9/1976 | France . |
| 2333717 | 7/1977 | France . |
| 2342217 | 9/1977 | France . |

(List continued on next page.)

| | | |
|---|---|---|
| 2167050 | 5/1986 | United Kingdom . |
| 2171680 | 9/1986 | United Kingdom . |
| 218777 | 9/1987 | United Kingdom . |
| 2190903 | 12/1987 | United Kingdom . |
| 2209156 | 5/1989 | United Kingdom . |
| 2210360 | 6/1989 | United Kingdom . |
| 2212792 | 8/1989 | United Kingdom . |
| WO 91/18822 | 12/1991 | WIPO . |

*Primary Examiner*—Stephen Cronin
*Assistant Examiner*—Nathan Newhouse
*Attorney, Agent, or Firm*—Nixon & Vanderhye

[57] ABSTRACT

A cap (1) for a container having a screw threaded opening comprising an inner part (3) in the form of a screw threaded cap, an outer part (2) the inner part (3) being axially displaceable relative to the outer part (2) and biased therefrom between an unlocking and locking position, resilient biasing means (17) between the inner and outer parts, a boss (6), and engagement means (15) adapted to engage with the boss upon (6) depression of the outer part (2), such that turning the cap will unscrew it from the container wherein one of the boss (6) or engagement means (15) is located on the top surface of the inner part (3) and the other is located on the inner top surface of the outer part (2).

17 Claims, 4 Drawing Sheets

U.S. PATENT DOCUMENTS

| | | | |
|---|---|---|---|
| 4,555,036 | 11/1985 | Bekkers et al. . | |
| 4,635,806 | 1/1987 | Williamson . | |
| 4,669,620 | 6/1987 | Coifman . | |
| 4,673,095 | 6/1987 | Puresevic et al. | 215/220 |
| 4,747,500 | 5/1988 | Gach . | |
| 4,775,061 | 10/1988 | Coote . | |
| 4,782,965 | 11/1988 | Wassilieff . | |
| 4,801,028 | 1/1989 | Puresevic et al. | 215/220 |
| 4,832,218 | 5/1989 | Gibilisco . | |
| 4,854,459 | 8/1989 | DeJonge . | |
| 4,998,989 | 3/1991 | Curiel . | |
| 5,020,681 | 6/1991 | Kusz | 215/220 |
| 5,054,633 | 10/1991 | Reijenga . | |
| 5,114,029 | 5/1992 | Gibilisco . | |
| 5,667,085 | 9/1997 | Ogden et al. | 215/220 |

FOREIGN PATENT DOCUMENTS

| | | |
|---|---|---|
| 2387167 | 11/1978 | France . |
| 2468516 | 8/1981 | France . |
| 2546854 | 12/1984 | France . |
| 2596364 | 10/1987 | France . |
| 2602747 | 2/1988 | France . |
| 2234532 | 2/1973 | Germany . |
| 36 05 963 | 8/1987 | Germany . |
| 40 02 967 | 5/1991 | Germany . |
| 41 12 209 | 10/1992 | Germany . |
| 41 21 540 | 1/1993 | Germany . |
| 195765 | 11/1984 | New Zealand . |
| 1 265 460 | 3/1972 | United Kingdom . |
| 1 334 023 | 10/1973 | United Kingdom . |
| 1 339 867 | 12/1973 | United Kingdom . |
| 1 349 114 | 3/1974 | United Kingdom . |
| 1 377 615 | 12/1974 | United Kingdom . |
| 1 377 785 | 12/1974 | United Kingdom . |
| 1 386 369 | 3/1975 | United Kingdom . |
| 1387104 | 3/1975 | United Kingdom . |
| 1426792 | 3/1976 | United Kingdom . |
| 1503863 | 3/1978 | United Kingdom . |
| 1508358 | 4/1978 | United Kingdom . |
| 1522019 | 8/1978 | United Kingdom . |
| 2060582 | 5/1981 | United Kingdom . |
| 1602611 | 11/1981 | United Kingdom . |
| 1602612 | 11/1981 | United Kingdom . |
| 0056887 | 8/1982 | United Kingdom . |
| 2099802 | 12/1982 | United Kingdom . |
| 2100238 | 12/1982 | United Kingdom . |
| 2108940 | 5/1983 | United Kingdom . |
| 2131776 | 6/1984 | United Kingdom . |
| 2134892 | 8/1984 | United Kingdom . |
| 2137599 | 10/1984 | United Kingdom . |
| 2138410 | 10/1984 | United Kingdom . |
| 2141697 | 1/1985 | United Kingdom . |
| 2143218 | 2/1985 | United Kingdom . |
| 2146008 | 4/1985 | United Kingdom . |
| 2156323 | 10/1985 | United Kingdom . |

CAP FOR A CONTAINER

This invention relates to a cap for a container, particularly a pharmaceutical container.

BACKGROUND OF THE INVENTION

British patent no. 2167050 relates to a two part child resistant pharmaceutical bottle cap which includes a hexagonal boss on the upper surface of the inner part which on depression of the outer part, locks into a hexagonal aperature in the top of the outer part. Twisting of the outer part in this locked position then releases the cap from the bottle. In the unlocked (child safety) position, however, there is a slight overlap between the uppermost edge of the boss and the innermost edge of the wall of the aperture, so that rotation of the outer part wears and rounds the corners of the boss eventually making it more difficult to lock with the aperture and thus release the cap.

In addition, some medicines are viscous which can result in the inner part becoming firmly stuck to the container. This leads to additional force being required to open the container which can speed up the wearing process.

SUMMARY OF THE INVENTION

Thus, the present invention provides a cap for a container having a screw threaded opening comprising an inner part in the form of a screw threaded cap, an outer part, the inner part being axially displaceable relative to the outer part and biased therefrom between an unlocking and locking position, resilient biasing means between the inner and outer parts, a boss, and engagement means adapted to engage with the boss upon depression of the outer part, a plurality of projections and a second engagement means adapted to engage with said plurality of projections upon depression of the outer part, such that turning the cap will unscrew it from the container, wherein one of the boss or engagement means is located on the top surface of the inner part and the other is located on the inner top surface of the outer part, and wherein one of the plurality of projections or second engagement means is located on the top surface of the inner part and the other is located on the inner top surface of the outer part.

In a preferred embodiment of the invention the boss is hexagonal and is located on the inner part and the engagement means consists of a plurality of spaced corner pieces located on the outer part.

Preferably the plurality of projections is located on the inner part and the second engagement means is located on the outer part.

In a particularly preferred embodiment the second engagement means consists of a plurality of dogs associated with the resilient biasing means.

In a third preferred embodiment the outer part of the cap has a substantially central aperture covered by a tamper evident cover connected to the outer part by a hinge portion and at least one frangible portion, and the boss carries a spigot which upon depression of the outer part projects through the aperture with sufficient force to break the least one frangible portions.

In another aspect the present invention provides a cap for a container having a screw threaded opening comprising an inner part, in the form of a screw threaded cap, an outer part, the inner part being axially displaceable relative to the outer part and biased therefrom between an unlocking and locking position, resilient biasing means between the inner and outer parts, a boss located on the inner part, a plurality of projections and engagement means adapted to engage with the projections upon depression of the outer part, wherein the outer part has a substantially central aperture into which the boss is received upon depression of the outer part, such that the boss engages with the aperture on unscrewing the cap.

In a preferred embodiment of this aspect of the invention the boss is hexagonal and the plurality of projections are located on the inner part and the engagement means on the outer part.

Preferably the engagement means consists of a plurality of dogs associated with the biasing means.

In a further preferred embodiment the aperture is covered by a tamper evident cover connected to the outer part by a hinge portion and at least one frangible portion, such that upon depression of the outer part the at least one frangible portion is ruptured by the boss received in the aperture.

In addition, it has been found that coating at least one of the outer or inner parts with silicone can aid the effectiveness of the invention. Preferably the inner part is substantially coated with silicone. This coating reduces torque allowing the biasing means to be made of thicker and/or stronger material. It may also aid in reducing "gumming up" of the cap by viscous liquids. Finally it also reduces the chance that the outer part can be pinched hard against the inner part resulting in engagement and opening.

The container cap of the present invention are preferably made of plastics material.

In another aspect the invention relates to containers equipped with a container cap of the invention, preferably pharmaceutical containers.

BRIEF DESCRIPTION OF THE DRAWINGS

The invention will now be described by way of example only with reference to the accompanying drawings in which.

DETAILED DESCRIPTION OF PREFERRED EMBODIMENTS

Figure 1:
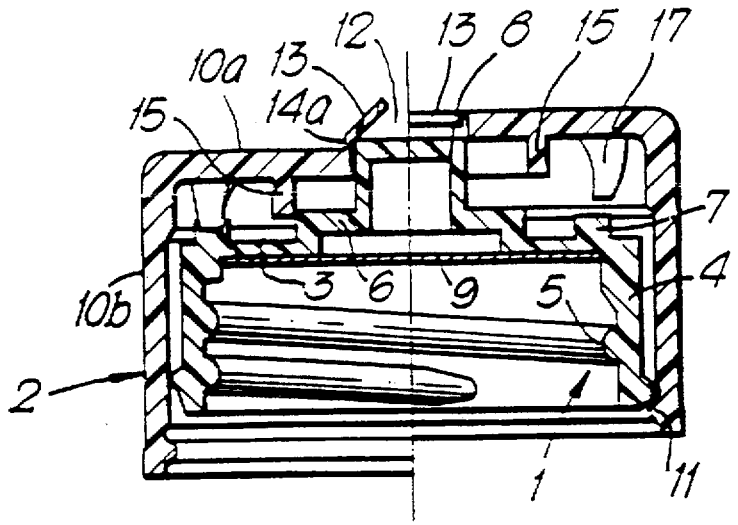
FIG. 1 is a cross-sectional view of a cap of the invention in its unlocked position (right-hand side) and locked position (left-hand side)

In FIG. 1 it can be seen that the cap comprises a hollow inner part 1 receivable within an outer (shell), part 2 in a snap fit manner. The inner part 1 comprises a planar circular top 3 with a depending annular skirt 4 having an inner screw thread 5. A central hexagonal boss 6 extends upwardly from the top 3 of the inner part 1 and a plurality of spaced studs 7 are arranged therearound adjacent respective corners of the hexagonal boss 6. A spigot 8 projects from boss 6 and a linear wad 9 is located against: the lower surface of the top 3 of the inner part 1.

The outer part 2 also comprises a planar circular top 10*a* with a depending circular skirt 10*b* having a circular bead 11 around its lower inner edge, over which the lower edge of the inner piece snap fits. A small central aperture 12 is provided on the top of the outer part 10 and is covered by a tamper evident cover piece 13 held in place at diametrically opposed positions by a hinge 14*a* and a frangible web 14*b*. On depressing the outer part 2 for the first time the spigot 8 projects into the aperature 12 with sufficient force to rupture the frangible portion 14*b*, thus providing tamper evidence.

Spaced outwardly from the central aperture 12 and extending downwardly from, and formed integrally with, the inner surface of the top 10 of the outer part 2 are a plurality of corner pieces 15 conforming in outline to the hexagonal boss 6 in a formation of three diametrically opposed pairs. Each corner piece 15 is formed from two limbs of a wall angled at about 120° to neatly receive the corresponding corner of the hexagonal boss 6. In depth each corner-piece 15 is about the same, or about twice the thickness of the top wall of the outer piece 2, and the spacing is about half the length of a limb (although this is not critical and it can be e.g. a third, three-quarters of a length spacing). In this embodiment, there is an overlap between the upper edge of the boss 6 and the lower edge of the corner-pieces 15.

Six resilient tongues 17 forming biasing means also depend at an angle from the inner surface of the top of the outer part 2 and are serially arranged in a circular fashion between the corner-pieces 15 and the skirt 10*b*. Extending downwardly adjacent the root of each tongue 17, is a corresponding abutment or dog 18.

In operation when the outer part 2 is rotated clockwise, the free ends of the tongues 17 abut the respective studs 7 on the top of the inner part 3 to screw it and the whole cap onto the bottle. If, however, the outer part 2 is turned in a counter clockwise direction without also pressing down, the outer part will turn freely relative to the inner member 3 with the free ends of the tongues 17 riding over the tops of the studs 7 of the inner part 2.

Furthermore on counter-rotation, even though there is a slight overlap between the inner edges of the corner-pieces 15 and the boss 6, the wear on the corners of the boss 6 is considerably reduced as a result the gaps between the corner-pieces 15 (that is the area of contact which previously wore the corners, has been reduced).

On depression of the outer part 2 the corners of the boss 6 are received neatly into the corner-pieces 15 in a gripping fashion so that the top of the boss 6 lies adjacent or abuts the inner surface of the top 10 of the outer part 2 and the spigot 8 abuts against the tamper evident cover piece 13 breaking the frangible connecting web 14*b* and hinging open the cover piece 13 (as shown in the left handside of FIG. 1). In this position the abutments or dogs of the outer part 2 are locked behind the studs 7 of the inner part 1 to release/unscrew the cap from the bottle on clockwise rotation. If, however, this first opening mechanism fails (e.g. due to gumming up of the studs by a pharmaceutical substance), then the boss 6 which is now locked into the corner-pieces 15 will still be available (as a second opening mechanism) for releasing the cap 1.

Figure 2:
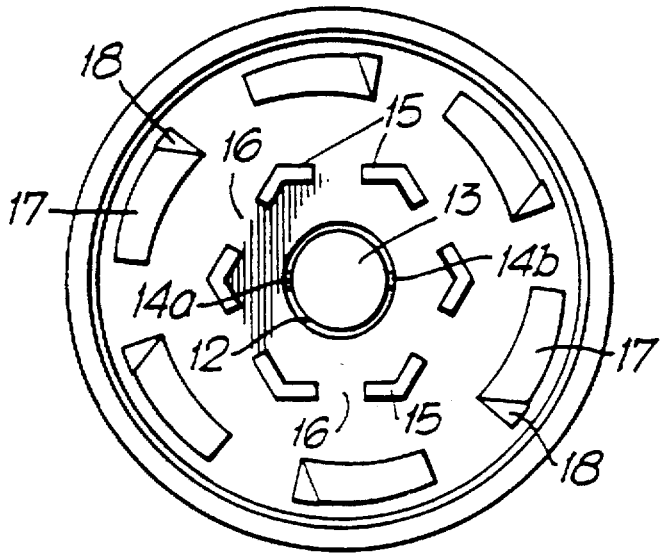
FIG. 2 is an underneath plan view of the outer par: of the cap of FIG. 1 showing parts of the internal mechanism thereof.

In FIG. 2 the relationship between the spaced corner pieces 15 around the aperature 12 can be more clearly seen. The gaps between the corner pieces 15 greatly reduce wear on the boss received therein. Also the arrangement of the biasing tongues 17 and the abutments or dogs 18 is shown. Thus, the two separate engagement mechanisms and their relationship is portrayed.

Figure 3:
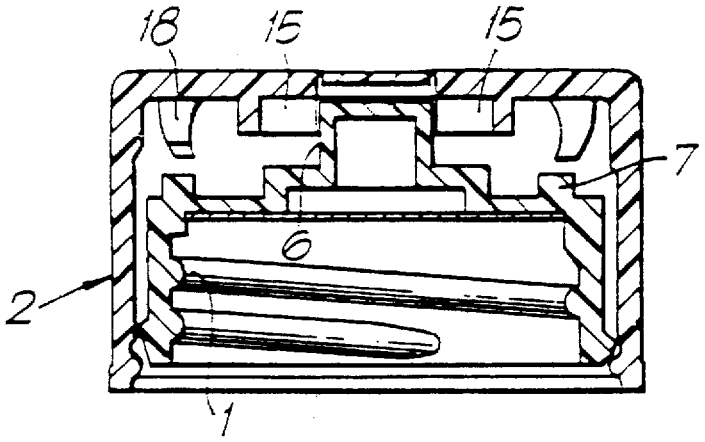
FIG. 3 is further cross-sectional axial view of the cap in the locked position.

FIG. 3 simply shows the cap of FIG. 1 in the unlocked position, i.e. before depression of the outer cap 2.

Figure 4:
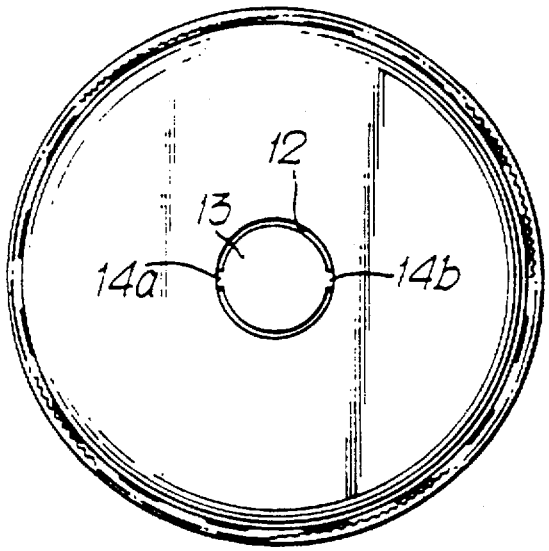
FIG. 4 is a plan view of cap of FIG. 1 but not showing any internal mechanism.

FIG. 4 shows the exterior upper surface of the cap 1 before the container has been opened for the first time. Thus, the frangible portion 14*b* is intact and the tamper evident cover 13 is still in place.

Figure 5:
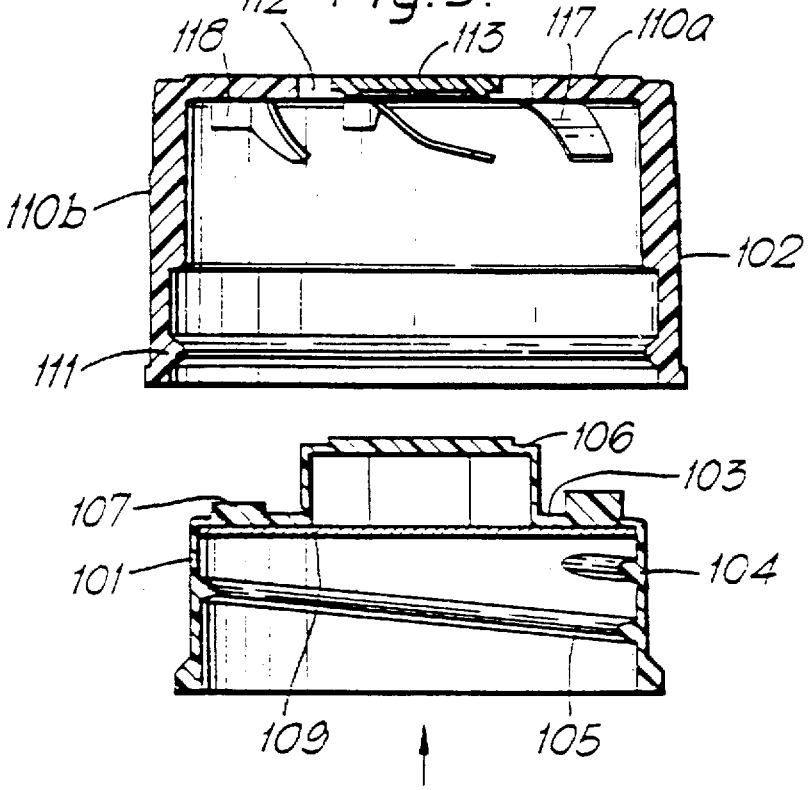
FIG. 5 is a cross-sectional view of another embodiment of the invention.

In FIG. 5 another embodiment of the invention is shown. Once again a hollow inner part 101 is received within an outer (shell) part 102 in a snap fit manner. The inner part 101 comprises a planar circular top 103 with a depending annular skirt 104 having an inner screw thread 105. A central hexagonal boss 106 extends upwardly from the top 103 of the inner part 101 and a plurality of spaced studs 107 are arranged therearound adjacent respective corners of the hexagonal boss 106. A linear wad 109 is located against the lower surface of the top 103 of the inner part 101.

The outer par: 102 also comprises a planar circular top 110*a* with a depending circular skirt 110*b* having a circular bead 111 around its lower inner edge, over which the lower edge of the inner piece snap fits. A hexagonal aperture 112 is provided on the top of the outer part 102 and is covered by a tamper evident cover piece 113 held in place at diametrically opposed positions by a hinge 114*a* and a frangible web 114*b*.

Six resilient tongues 117 forming biasing means depend at an angle from the inner surface of the top of the outer part 102 and are serially arranged in a circular fashion. Extending downwardly adjacent the root of each tongue 117, is a corresponding abutment or dog 118.

In operation when the outer part 102 is rotated clockwise, the free ends of the tongues 117 about the respective studs 107 on the top of the inner part 103 to screw it and the whole cap onto the bottle. If, however, the outer part 102 is turned in a counter clockwise direction without also pressing down, the outer part will turn freely relative to the inner member 103 with the free ends of the tongues 117 riding over the tops of the studs 107 of the inner part 102.

On depression of the outer part 102 the boss 106 is received in the aperture 112 such that the boss 106 abuts the sides of the aperture 112, and against the tamper evident cover piece 113 breaking the frangible connecting web 114*b* and hinging open the cover piece 113. In this position the abutments or dogs 118 of the outer part 102 are locked behind the studs 107 of the inner part 102 to release/unscrew the cap from the bottle on clockwise rotation. In this cap the locking of the boss 106 into he aperture 112 and the studs/abutments opening means provide back up to each other for opening the cap.

Figure 6:
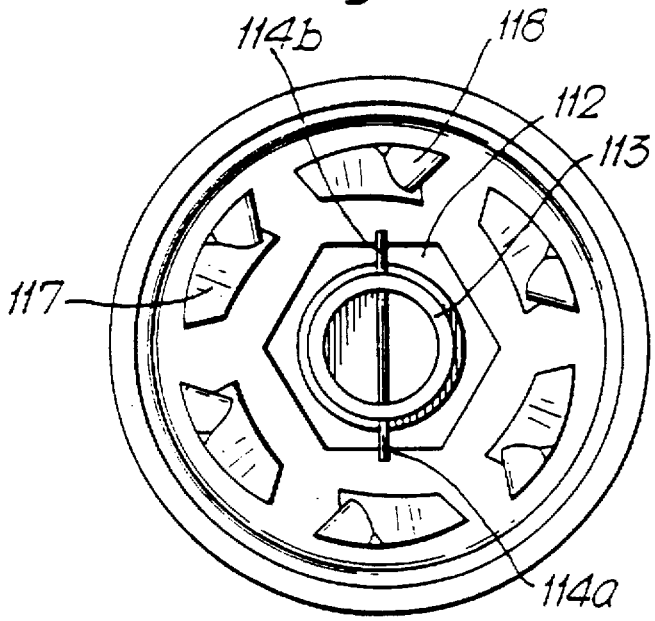
FIG. 6 shows the outer part of the cap of FIG. 5, in underneath plan view.

In FIG. 6 it can be seen that in this embodiment the arrangement of the resilient tongues 117 and abutments/dogs 118 is essentially the same as for the outer par: of the cap shown in FIG. 1. Here however instead of corner pieces there is provided a hexagonal aperture 112 adapted to receive the boss 106.

Figure 7:
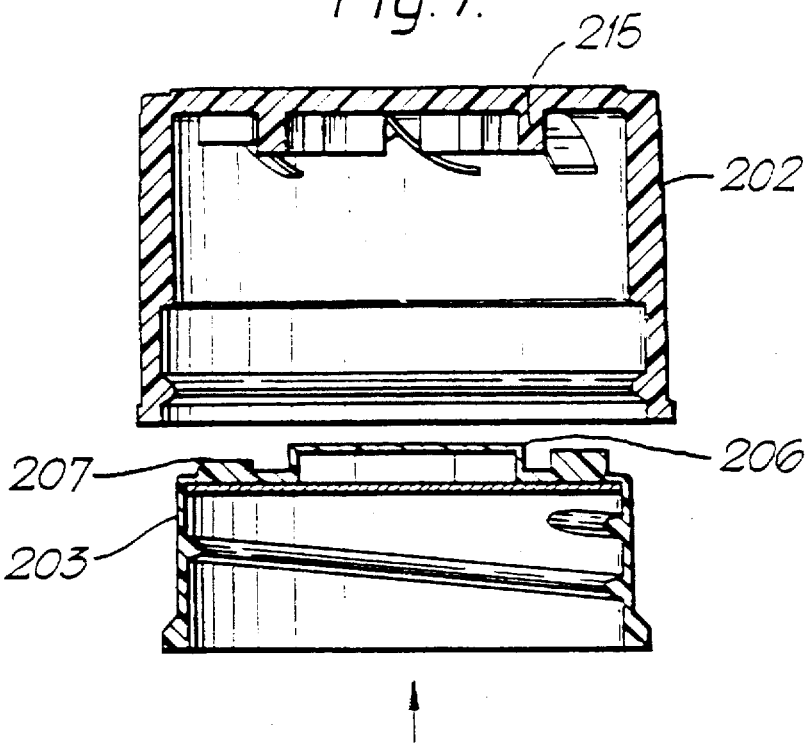
FIG. 7 is a cross-sectional view of another cap of the invention.
Figure 8:
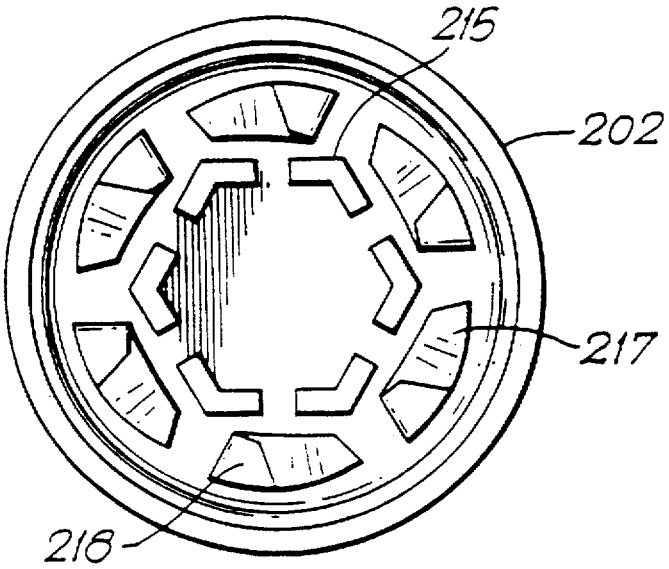
FIG. 8 shows the outer part of the cap of FIG. 7 in underneath plan view.

FIGS. 7 and 8 show a further embodiment of the invention in which there is no tamper evident cover provided. In this embodiment the inner part 202 is provided with a boss 206 which is received within a plurality of spaced corner pieces 215 located on the under surface of the outer part 202. Similarly resilient tongues 217 depend downwards from the outer part 202 and have abutments/dogs 218 associated with them which lock behind studs 207 located on the inner piece 203. This cap operates in the same way as the cap shown in FIG. 1 except that no tamper evidence is provided.

It will be appreciated that other shapes of boss could be used, such as for example a square or a triangle, although a hexagonal boss 6 is a preferred embodiment because it has more gripping points/corners. Furthermore there does not have to be a corresponding number of corner-pieces as corners as long as they are strategically positioned to sufficiently grip and rotate the inner part without putting too much stress on the corner-pieces (i.e. to damage them). In the case of a symmetrical shaped boss such as a square or hexagon, preferably each corner-piece 215 is substantially opposite another corner-piece 215. Thus for a hexagonal boss 206 although an opposed pair of corner-pieces 215 may be used preferably there are two opposed pairs, most preferably three opposed pairs.

I claim:

1. A two piece cap for a container having a screw threaded opening comprising:

an inner part in the form of a screw threaded cap having a top surface; an outer part having an inner top surface, the inner part being axially displaceable relative to the outer part and biased therefrom between an unlocking and locking position;

resilient biasing means between the inner and outer parts;

a boss;

first engagement means engageable with the boss upon depression of the outer part, and a plurality of projections and a second engagement means engageable with said plurality of projections upon depression of the outer part, such that turning the cap will unscrew it from the container;

wherein one of the boss or first engagement means is located on the top surface of the inner part and the other is located on the inner top surface of the outer part; and wherein one of the plurality of projections or second engagement means is located on the top surface of the inner part and the other is located on the inner top surface of the outer part.

2. The cap as claimed in claim 1 where the boss is located on and extends upwardly from the top surface of the inner part and the first engagement means is located on and extends downwardly from the inner top surface of the outer part.

3. The cap as claimed in claim 2 wherein the boss is hexagonal and there are two or three pairs of substantially opposed corner pieces, for receiving and engaging with the hexagonal boss.

4. The cap as claimed in claim 1 wherein the outer part has a substantially central aperture covered by a tamper evident cover connected to the outer part by a hinge portion and at least one frangible portion, and the boss carries a spigot which upon the depression of the outer part projects through said aperture with sufficient force to break at least one frangible portion.

5. The cap as claimed in claim 1 wherein the boss is hexagonal and there are two or three pairs of substantially opposed corner pieces for receiving and engaging with the hexagonal boss.

6. The cap as claimed in claim 5 wherein each corner piece is formed from two limbs of a wall angled at about 120° to neatly receive the corresponding corner of the hexagonal boss.

7. The cap as claimed in claim 6 wherein in depth each corner piece is about the same or about twice the thickness of the top wall of the outer part.

8. The cap as claimed in claim 1 wherein the plurality of projections is located on the inner part and the second engagement means is located on the outer part.

9. The cap as claimed in claim 8 wherein the second engagement means consists of a plurality of dogs associated with resilient biasing means, and the dogs lock with the projections on depression of the outer part.

10. The cap as claimed in claim 1 wherein at least one of an outer surface of the inner part and an inner surface of the outer part is substantially coated with silicone.

11. The cap as claimed in claim 10 wherein the outer surface of the inner part is substantially coated with silicone.

12. The cap as claimed in claim 1 which is made of plastics material.

13. A container having a screw threaded opening, wherein the container is equipped with a cap as claimed in claim 1, such that the screw threads of the container engage the threads on the inner part of the cap.

14. The container as claimed in claim 13 which is a pharmaceutical container.

15. A two piece cap for a container having a screw threaded opening comprising:

an inner part in the form of a screw threaded cap having a top surface;

an outer part having an inner top surface, the inner part being axially displaceable relative to the outer part and biased therefrom between an unlocking and locking position;

resilient biasing means between the inner and outer parts;

a boss extending upwardly from the top surface of the inner part;

a plurality of spaced corner pieces extending downwardly from the inner top surface of the outer part, said corner pieces conforming in outline and engageable with the boss upon depression of the outer part;

a plurality of projections; and a second engagement for engaging with said plurality of projections upon depression of the outer part, wherein one of the plurality of projections or second engagement means is located on the top surface of the inner part and the other is located on the inner top surface of the outer part.

16. The cap as claimed in claim 15 wherein the boss is hexagonal and the corner pieces are in three diametrically opposed pairs conforming in outline to the hexagonal boss.

17. A two piece cap for a container having a screw threaded opening comprising:

an inner part in the form of a screw threaded cap having a top surface;

an outer part having an inner top surface, the inner part being axially displaceable relative to the outer part and biased therefrom between an unlocking and locking position;

resilient biasing means between the inner and outer parts;

a boss;

first engagement means engageable with the boss upon depression of the outer part; a plurality of projections and a second engagement means engageable with said plurality of projections upon depression of the outer part, such that turning the cap will unscrew it from the container;

wherein one of the boss or first engagement means is located on the top surface of the inner part and the other is located on the inner top surface of the outer part;

wherein one of the plurality of projections or second engagement means is located on the top surface of the inner part and the other is located on the inner top surface of the outer part; and wherein the outer part has a substantially central aperture covered by a tamper-evident cover and at least one frangible portion, and the boss carries a spigot which upon depression of the outer part projects through said aperture with sufficient force to break at least one frangible portion of the tamper-evident cover.

* * * * *